US006201512B1

(12) United States Patent
Wu

(10) Patent No.: US 6,201,512 B1
(45) Date of Patent: Mar. 13, 2001

(54) BIAXIALLY ROTATIONAL STRUCTURE

(75) Inventor: Ching-Cheng Wu, Hsinchu (TW)

(73) Assignee: RF-Link Systems, Inc., Hsinchu (TW)

( * ) Notice: Subject to any disclaimer, the term of this patent is extended or adjusted under 35 U.S.C. 154(b) by 0 days.

(21) Appl. No.: 09/419,118

(22) Filed: Oct. 15, 1999

(51) Int. Cl.[7] ..... H01Q 3/02

(52) U.S. Cl. ..... 343/882; 343/765; 343/878; 343/892; 74/5.7; 244/3.16; 318/35

(58) Field of Search ..... 343/757, 765, 343/878, 880, 882, 883, 892; 74/5.7, 89.22; 248/583, 602; 244/3.16, 3.19; 318/35, 51; H01Q 3/02

(56) References Cited

U.S. PATENT DOCUMENTS 4,558,325 * 12/1985 Strom ..... 343/765
4,580,461 * 4/1986 Sears et al. ..... 343/765
4,786,913 * 11/1988 Barendregt et al. ..... 343/765
4,792,812 * 12/1988 Rinehart ..... 343/781 R
5,153,485 * 10/1992 Yamada et al. ..... 343/766

* cited by examiner

*Primary Examiner*—Tho Phan
(74) *Attorney, Agent, or Firm*—Armstrong, Westerman, Hattori, McCleland & Naughton, LLP

(57) ABSTRACT

A biaxially rotational structure for a planar antenna comprises a biaxial base having a vertical direction and a horizontal direction, a vertical shaft assembly disposed at the vertical direction of the biaxial base, the vertical shaft assembly has a rotation limiting member; a support frame pivotally mounted on the vertical shaft assembly, the support frame having a stopper extending downwardly in a manner that the rotation limiting member limits the stopper to rotate within one turn with respect to the vertical shaft assembly; a first resilient member disposed between the vertical shaft assembly and the support frame for exerting a pressing force on the support frame; a horizontal shaft assembly disposed at the horizontal direction; and a second resilient member disposed between the horizontal shaft assembly and the biaxial base for exerting a friction force therebetween. Therefore, the biaxially rotational structure of the present invention will prevent the user from unlimitedly rotating the planar antenna 1 along the directional angle (vertical direction), thereby the cable therein might not be tangled and broken.

14 Claims, 4 Drawing Sheets

BIAXIALLY ROTATIONAL STRUCTURE

BACKGROUND OF THE INVENTION

1. Field of the Invention

This invention generally relates to a biaxially rotational structure, and more particularly to a biaxially rotational structure for a planar antenna in which the angle of the planar antenna can be adjusted biaxially.

2. Description of the Related Art

Conventional antenna for one-dimension polarized wireless communication is configured as a retractable elongated rod. For receiving the one-dimension polarized wireless communication signals, the conventional retractable elongated antenna can be adjusted its orientation at its joint according to the polarized direction of the one-dimension polarized wireless communication signals. However, due to the obstruction of any barriers and the interference of any other signals or electromagnetic fields, the one-dimension polarized wireless communication signal will significantly decay in the transmission path. Even though the antenna is adjusted to its optimal position, the one-dimension polarized wireless communication signal received by the antenna is still not clear enough as required.

In order to overcome the disadvantages of the one-dimension polarized wireless communication, a planar antenna for two-dimension polarized wireless communication is developed. With the radio frequency (RF) signal, the distances that the planar antenna can cover are much greater. For use in the two-dimension polarized wireless communication, the planar antenna has two freedoms of rotation such that the inclined angle and the directional angle of the planar antenna can be adjusted to conform to the polarized angle of the two-dimension polarized wireless communication signal. Accordingly, the planar antenna can receive better wireless communication signal.

FIG. 1 depicts a conventional planar antenna which mainly comprises an antenna 1, a box set 2, a hollow tube body 31, ear members 32, a plate 41, two supports 42, screws 43 and a cable. The supports 42 of the plate 41 press against the ear members 32 of the hollow tube body 31 such that the frictional force between the supports 42 and the ear members 32 enables the hollow tube body 31 to rotate horizontally with respect to the box set 2. The antenna 1 also can rotate with respect to vertical direction of the box set 2. According to the conventional planar antenna, the user might rotate the planar antenna along the vertical direction without any limitation and the cable therein might be tangled or even be broken. Besides, the conventional planar antenna utilizes friction force to sustain the twist force of the cable and the gravity force of the planar antenna. When the conventional planar antenna has been used for a long while, the frictional parts of the conventional planar antenna will wear out and thus will not function well any longer.

SUMMARY OF THE INVENTION

It is a primary object of the present invention to provide a. biaxially rotational structure for a planar antenna, wherein the biaxially rotational structure is provided with a rotation limiting mechanism for preventing the user from unlimitedly rotating the planar antenna along the directional angle (vertical direction), thereby the cable therein might not be tangled and broken.

It is another object of the present invention to provide a. biaxially rotational structure for a planar antenna, wherein the biaxially rotational structure is provided with resilient friction members at each axial direction to enhance the frictional torsion between each axially rotation members.

It is a further object of the present invention to provide a. biaxially rotational structure for a planar antenna, wherein the biaxially rotational structure is made of metal material so as to enhance the mechanical strength and elongate the use life.

According to one aspect of the present invention, the biaxially rotational structure mainly includes a biaxial base, a vertical shaft assembly disposed at the vertical direction of the biaxial base, a support frame pivotally mounted on the vertical shaft assembly for supporting an antenna, and a horizontal shaft assembly disposed at the horizontal direction of the biaxial base, wherein the biaxial base can rotate with respect to the horizontal shaft assembly and the support frame can rotate along the vertical shaft assembly with respect to the biaxial base. A mounting member presses a resilient washer against the support frame such that a pressing force from the resilient washer is always exerted on the support frame and depresses the support frame against the vertical shaft assembly. Accordingly, when the biaxially rotational structure of the present invention has been used for a long while, the friction torsion between the support frame and the vertical shaft assembly will be maintained. The horizontal shaft assembly has a shaft body and two resilient plates. When the shaft body and the resilient plates are inserted into the horizontal axial hole, the two resilient plates respectively depress against the shaft body. Thus, when the biaxially rotational structure of the present invention has been used for a long while, the friction forces among the shaft body, resilient plates and the horizontal axial hole will be maintained. According to the present invention, the biaxially rotational structure is provided with resilient friction members at each axial direction to enhance the frictional torsion between each axially rotation members so as to overcome the shortcomings of the conventional art.

According to another aspect of the present invention, the vertical shaft assembly is provided with a rotation limiting member at the second flange and the support frame is provided with a stopper near the mounting hole extending downwardly to the circumference of the second flange. When the support frame is rotated with respect to the vertical shaft assembly, the stopper of the support frame will be limited by the rotation limiting member of the vertical shaft assembly such that the support frame only can be rotated within one turn with respect to the vertical shaft assembly. Therefore, the biaxially rotational structure of the present invention will prevent the user from unlimitedly rotating the planar antenna along the directional angle (vertical direction), thereby the cable therein might not be tangled and broken.

Other objects, advantages, and novel features of the invention will become more apparent from the following detailed description when taken in conjunction with the accompanying drawings.

DETAILED DESCRIPTION OF THE PREFERRED EMBODIMENT

Figure 1:
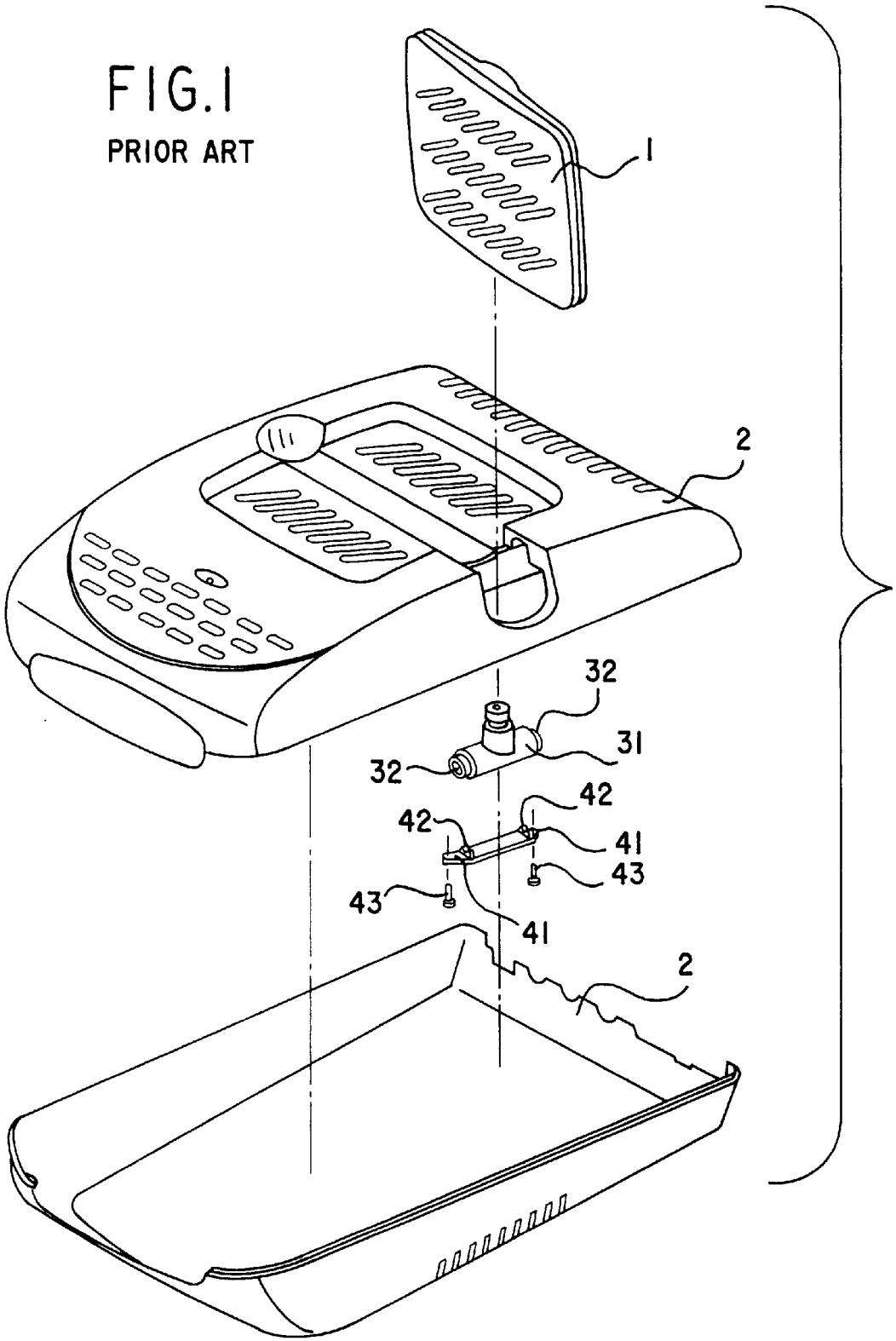
FIG.1 PRIOR ART
FIG. 1 is an exploded view of the conventional biaxially rotational structure for a planar antenna.
Figure 2:
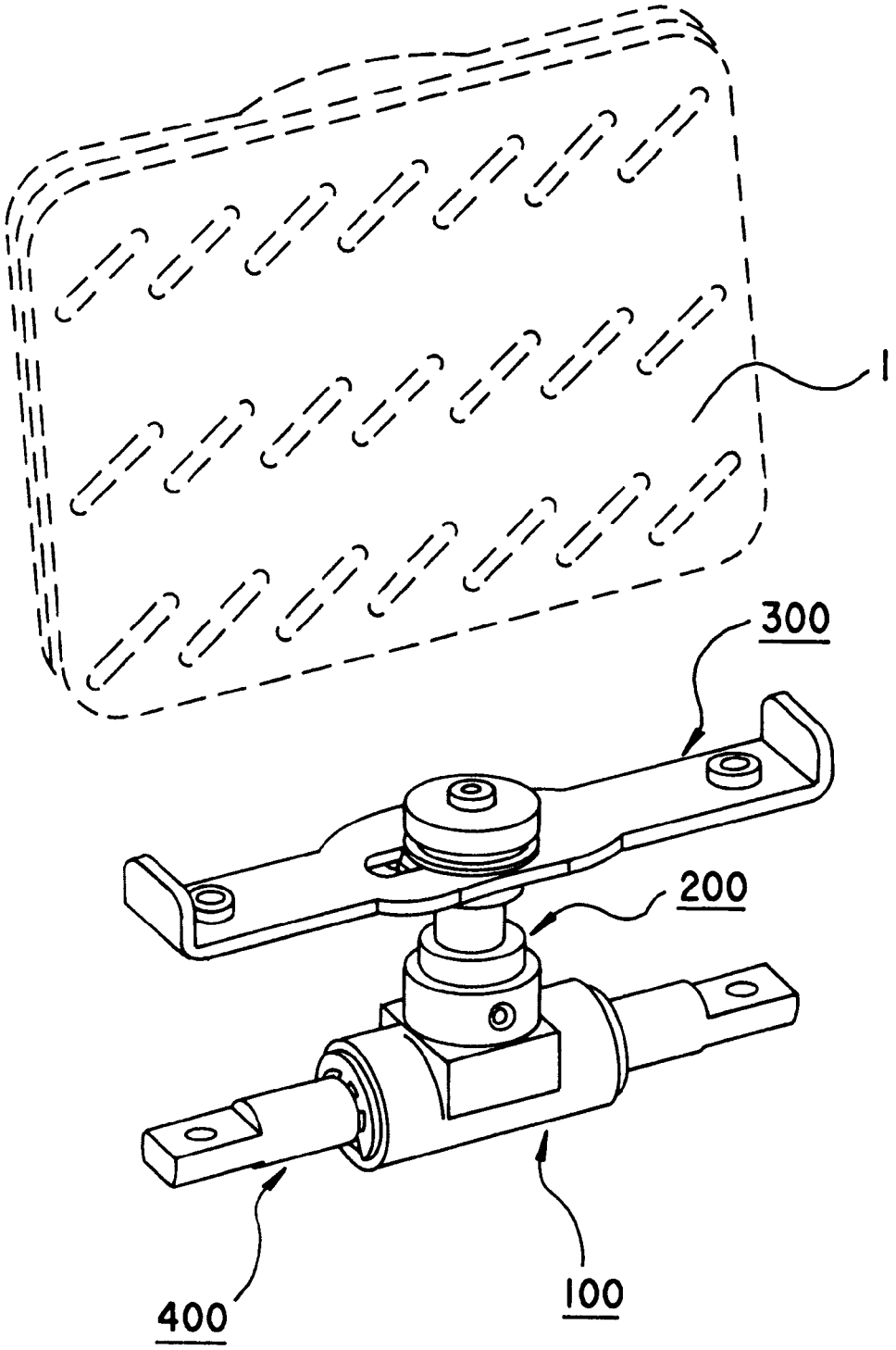
FIG. 2 is a perspective view of a biaxially rotational structure for a planar antenna in accordance with the present invention.

Referring to FIG. 2 firstly, the biaxially rotational structure for a planar antenna in accordance with the present invention mainly comprises a biaxial base 100, a vertical shaft assembly 200 disposed at the vertical direction (the directional angle of the planar antenna 1) of the biaxial base 100, a support frame 300 pivotally mounted on the vertical shaft assembly 200 for supporting an antenna 1, and a horizontal shaft assembly 400 disposed at the horizontal direction (the inclined angle of the antenna 1) of the biaxial base 100, wherein the biaxial base 100 can rotate with respect to the horizontal shaft assembly 400 and the support frame 300 can rotate along the vertical shaft assembly 200 with respect to the biaxial base 100 so as to adjust the inclined angle and the directional angle of the planar antenna 1 to conform to the polarized angle of the two-dimension polarized wireless communication signal. Accordingly, the planar antenna 1 can receive better wireless communication signals.

Figure 3:
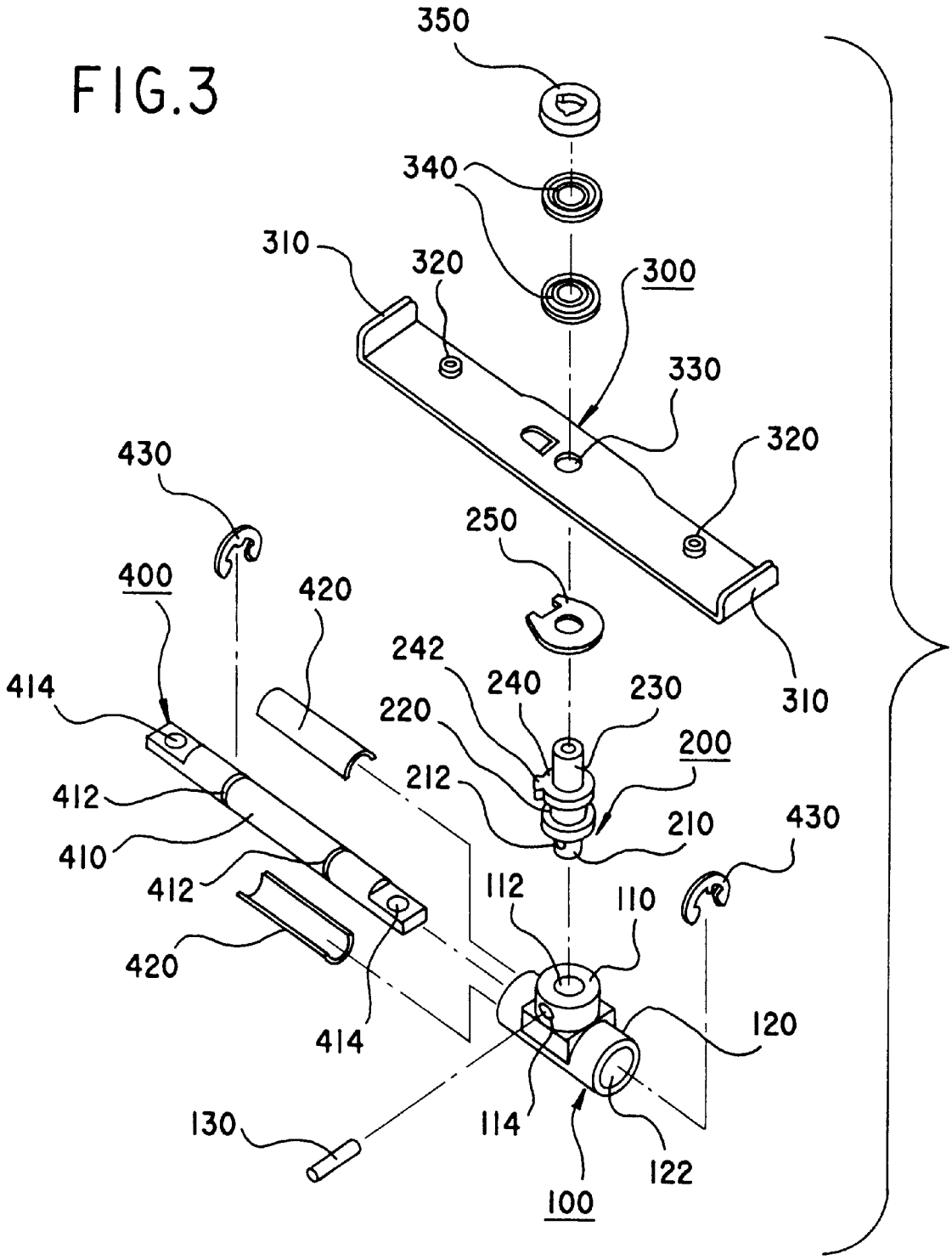
FIG. 3 is an exploded view of a biaxially rotational structure for a planar antenna in accordance with the present invention.
Figure 4:
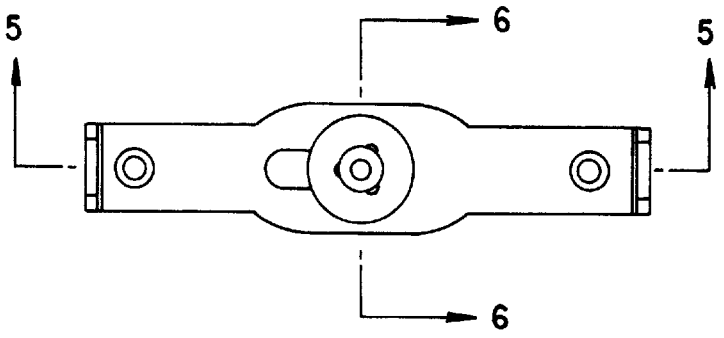
FIG. 4 is a top view of a biaxially rotational structure for a planar antenna in accordance with the present invention.
Figure 5:
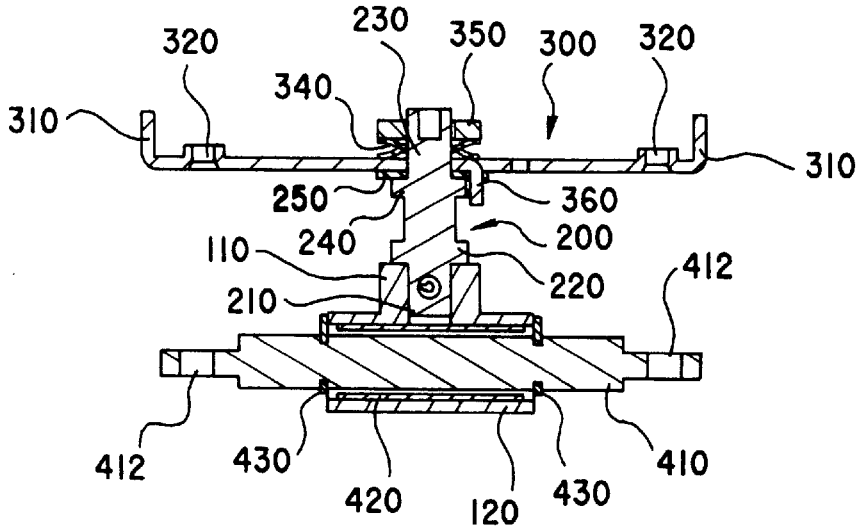
FIG. 5 is a cross-section view along line 5—5 of FIG. 4.

FIG. 3 illustrates the exploded view of a biaxially rotational structure for a planar antenna in accordance with the present invention. The biaxial base 100 is configured as T-branch shape having a vertical tube 110 and a horizontal tube 120, wherein the first shaft 210 of the vertical shaft assembly 200 is inserted into the first opening 112 of the vertical tube 110 and the horizontal shaft assembly 400 is inserted into the second opening 122 of the horizontal tube 120. The vertical shaft assembly 200 includes a first shaft 210 extending downwardly with a first flange 220 positioned at the upper end thereof and a second shaft 230 extending upwardly with a second flange 240 positioned at the lower end thereof. When the first shaft 210 of the vertical assembly 200 is inserted into the first opening 112 of the vertical tube 110, the first flange 220 of the vertical shaft assembly 200 is sustained on the upper end of the vertical tube 110 and a position pin 130 is inserted through the position hole 114 of the vertical tube 110 into the position hole 212 of the first shaft 210 such that the vertical shaft assembly 200 is positioned and mounted onto the vertical tube 110 of the biaxial base 100.

Then, a gasket 250 is disposed onto the second shaft 230 and is supported by the second flange 240. When the second shaft 230 is inserted into the mounting hole 330 of the support frame 300, the resilient washers 340 is disposed onto the second shaft 230 and a mounting member 350 presses the resilient washer 340 against the support frame 300, thereby the support frame 300 is pivotally mounted on the second shaft 230. The horizontal shaft assembly 400 includes a shaft body 410 and two resilient plates 420, and the shaft body 410 has two positioning grooves 412 spaced slightly longer than the length of the horizontal tube 120. After the shaft body 410 and the resilient plates are inserted into the second opening 122 of the horizontal tube 120, two positioning rings 430 respectively clamp the positioning grooves 412 such that the shaft body 410 is rotatably mounted inside the second opening 122 of the horizontal tube 120. According to the present invention, the positioning rings 430 can be either C-rings or E-rings. The fastener members fix the mounting holes 414 at the two ends of the shaft body 410 onto the antenna box.

Figure 6:
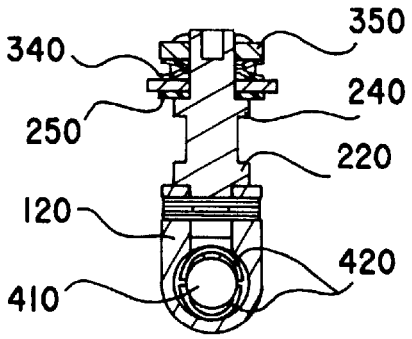
FIG. 6 is a cross-section view along line 6—6 of FIG. 4.

Referring FIGS. 3–6 again, the support frame 300 is pivotally mounted onto the vertical shaft assembly 200 and the mounting member 350 presses the resilient washers 340 against the support frame 300. Accordingly, the resilient washers 340 always exert a pressing force on the support frame 300 and force the support frame 300 against the gasket 250 on the second flange 240. As a result, after the structure of the present invention has been used for a long while, the friction forces among the support frame 300, resilient washers 340 and the gasket 250 will be still maintained such that the problems of the conventional art can be solved. Preferably, the resilient washers 340 are dish springs and are disposed face-to face between the support frame 300 and the mounting member 350 such that the resilient washers 340 will exert a better pressing force on the support frame 300. Preferably, the disk springs are made of spring steel or beryllium copper. After the shaft body 410 and the two resilient plates 420 are inserted into the second opening 122 of the horizontal tube 120, two positioning rings 430 respectively clamp the positioning grooves 412 such that the shaft body 410 is rotatably mounted inside the second opening 122 of the horizontal tube 120. As shown in FIG. 3 and 6, the two resilient plates 420 are configured as arc plates and preferably are made of spring steel or beryllium copper. The two resilient plates 420 always exert a pressing force on the shaft body 410. As a result, after the structure of the present invention has been used for a long while, the friction forces among the shaft body 410, resilient plates 420 and the second openings 122 will be still maintained such that the problems of the conventional art can be solved.

Referring to FIGS. 3 and 5 again, two mounting walls 310 extend upwardly from the two sides of the support frame 300 corresponding to the width of the planar antenna 1 and two mounting holes 320 are provided at the button portion of the support frame 300 so that the planar antenna 1 can be mounted on the support frame 300 by fasteners from the two mounting holes 320. The vertical shaft assembly 200 is provided with a rotation limiting member 242 at the second flange 240 and the support frame 300 is provided with a stopper 360 near the mounting hole 330 extending downwardly to the circumference of the second flange 240. Preferably, the rotation limiting member 242 is a protrusion at the second flange 240. When the support frame 300 is rotated with respect to the vertical shaft assembly 200, the stopper 360 of the support frame 300 will be limited by the rotation limiting member 242 of the vertical shaft assembly 200 such that the support frame 300 only can be rotated within one turn with respect to the vertical shaft assembly 200. Preferably, the support frame 300 only can be rotated within 300 degrees to 330 degrees with respect to the vertical shaft assembly 200. Therefore, the biaxially rotational structure of the present invention will prevent the user from unlimitedly rotating the planar antenna 1 along the directional angle (vertical direction), thereby the cable therein might not be tangled and broken. Besides, all parts of the biaxially rotational structure of the present invention are made of metal material so as to enhance the mechanical strength and elongate the use life.

Although the invention has been explained in relation to its preferred embodiment, it is to be understood that many other possible modifications and variations can be made without departing from the spirit and scope of the invention as hereinafter claimed.

What is claimed is:

1. A biaxially rotational structure for a planar antenna comprising:

a biaxial base having a vertical direction and a horizontal direction;

a vertical shaft assembly disposed at the vertical direction of the biaxial base, the vertical shaft assembly has a rotation limiting member;

a support frame pivotally mounted on the vertical shaft assembly, the support frame having a stopper extending downwardly in a manner that the rotation limiting member limits the stopper to rotate within one turn with respect to the vertical shaft assembly;

a first resilient member disposed between the vertical shaft assembly and the support frame for exerting a pressing force on the support frame;

a horizontal shaft assembly disposed at the horizontal direction; and a second resilient member disposed between the horizontal shaft assembly and the biaxial base for exerting a friction force therebetween.

2. The biaxially rotational structure as claimed in claim 1, wherein the biaxial base is configured as T-branch shape having a vertical tube and a horizontal tube, the vertical shaft assembly is inserted into the vertical tube and the horizontal shaft assembly is inserted into the horizontal tube.

3. The biaxially rotational structure as claimed in claim 2, further comprising a position pin for positioning the vertical shaft assembly to the vertical tube of the biaxial base.

4. The biaxially rotational structure as claimed in claim 1, wherein the first resilient member is a disk spring.

5. The biaxially rotational structure as claimed in claim 1, wherein the second resilient member is an arc spring plate.

6. The biaxially rotational structure as claimed in claim 5, wherein the support frame only can be rotated within 300 degrees to 330 degrees with respect to the vertical shaft assembly.

7. A biaxially rotational structure for a planar antenna comprising:

a biaxial base having a vertical tube and a horizontal tube;

a vertical shaft assembly having a first shaft extending downwardly with a first flange positioned at the upper end thereof and a second shaft extending upwardly with a second flange positioned at the lower end thereof, the first shaft is inserted inside the vertical tube with the first flange being sustained on the upper end of the vertical tube, the second flange having a rotation limiting member protruding therefrom;

a support frame pivotally mounted on the second shaft of the vertical shaft assembly, the support frame having a stopper extending downwardly in a manner that the rotation limiting member limits the stopper to rotate within one turn with respect to the vertical shaft assembly;

a first resilient member disposed between the vertical shaft assembly and the support frame for exerting a pressing force on the support frame;

a horizontal shaft assembly disposed at the horizontal tube, the horizontal shaft assembly having a shaft body and at least one resilient plate which are inserted inside the horizontal tube, the shaft body having two positioning grooves spaced slightly longer than the length of the horizontal tube; and two positioning rings respectively clamping the positioning grooves such that the shaft body is rotatably mounted inside the horizontal tube.

8. The biaxially rotational structure as claimed in claim 7, further comprising a position pin for positioning the vertical shaft assembly to the vertical tube of the biaxial base.

9. The biaxially rotational structure as claimed in claim 7, wherein the first resilient member is a disk spring.

10. The biaxially rotational structure as claimed in claim 7, wherein the first resilient member is made of spring steel.

11. The biaxially rotational structure as claimed in claim 7, wherein the first resilient member is made of beryllium copper.

12. The biaxially rotational structure as claimed in claim 7, wherein the positioning rings are C-rings.

13. The biaxially rotational structure as claimed in claim 7, wherein the positioning rings are E-rings.

14. The biaxially rotational structure as claimed in claim 7, wherein the support frame only can be rotated within 300 degrees to 330 degrees with respect to the vertical shaft assembly.

* * * * *